United States Patent [19]

Suzuki

[11] 4,442,363

[45] Apr. 10, 1984

[54] TIMER SWITCH FOR VEHICLE

[75] Inventor: Masaru Suzuki, Chiryu, Japan

[73] Assignee: Kabushiki Kaisha Tokai Rika Denki Seisakusho, Niwa, Japan

[21] Appl. No.: 456,431

[22] Filed: Jan. 7, 1983

[30] Foreign Application Priority Data

Jan. 19, 1982 [JP] Japan ..... 57-6495
Feb. 1, 1982 [JP] Japan ..... 57-14549

[51] Int. Cl.[3] ..... H01H 3/34; H01H 43/00

[52] U.S. Cl. ..... 307/141.4; 368/107; 335/123; 307/132 E

[58] Field of Search ..... 307/119, 120, 9, 10 R, 307/132 E, 132 EA, 141.4; 335/123, 138, 140, 239; 361/202; 368/87, 86, 107, 108

[56] References Cited

U.S. PATENT DOCUMENTS 3,943,415 3/1976 Minear ..... 307/132 E X
4,272,839 6/1981 Kitai et al. ..... 368/107

*Primary Examiner*—E. A. Goldberg
*Assistant Examiner*—Derek Jennings
*Attorney, Agent, or Firm*—Cushman, Darby & Cushman

[57] ABSTRACT

The timer switch comprises a setting member for setting a desired period, an escape wheel provided with saw-shaped teeth, a rack interposed between the setting member and the escape wheel for disengaging the setting member from the escape member while the setting member is operated and engaging the setting member with the escape wheel while the escape wheel turns, an anchor provided with a pair of claws, which is disposed so as to be opposed to the escape wheel, an electromagnetic member which begins to rock the anchor intermittently when the setting member is operated, so that the claws of the anchor are alternately engaged with the escape wheel. When the setting member is moved either along or about its axis, the escape wheel is disengaged from the setting member and the electromagnetic member begins to rock the anchor intermittently so that the claws of the anchor are alternately engaged with the escape wheel. Consequently, the escape wheel turns intermittently to engage the setting member with the escape wheel through the rack. As a result, the setting member moves intermittently at predetermined timings and by predetermined pitches.

14 Claims, 14 Drawing Figures

TIMER SWITCH FOR VEHICLE

BACKGROUND OF THE INVENTION

The present invention relates to a timer switch to be installed in a vehicle.

The vehicle is provided with timers for setting the window washer liquid injecting period and the window wiper operating period, etc. And a relatively long set period such as 5, 10, 15 minutes or the like is required in some case.

Conventionally, timers provided with a time constant circuit composed of a condensor and a resistor (hereinafter will be called RC timer circuit) have been generally used for the above purpose.

The RC timer circuit has a simple construction and the operational error thereof is very small when the set period is short, for example several seconds to over ten seconds. However, as the set period lengthens, the operational error enlarges in proportion thereto.

And it is difficult for the RC timer circuit to set a plurality of periods which are approximate to one another.

Accordingly, one object of the present invention is to provide a timer switch having a RC timer circuit for a vehicle, by which a comparatively long period can be set with little operational error.

Another object of the present invention is to provide a timer switch having a RC timer circuit for a vehicle, by which a large number of periods can be set with little operational error.

Still another object of the present invention is to provide a timer switch having a RC timer circuit for a vehicle, of which RC timer circuit is provided with a time ticking means composed of an escape wheel and an anchor.

SUMMARY OF THE INVENTION

The timer switch of the present invention comprises a setting member which is turned or operated upward and downward for setting a desired period by a turning angle or travelling distance thereof, a switching means which is switched on when a desired period is set by the setting member, a biasing means for biasing the setting member to its original position, an escape wheel provided with saw-shaped teeth in the outer periphery thereof, a clutch means which is interposed between the setting member and the escape wheel for disengaging the setting member from the escape wheel while the setting member is operated, and engaging the setting member with the escape wheel when the escape wheel turns, an anchor provided with a pair of claws, which is disposed so as to be opposed to the escape wheel, and an anchoring rocking means for rocking the anchor at constant periods so that the claws of the anchor are alternately engaged with the escape wheel.

The anchor rocking means comprises an electro-magnetic member for rocking the anchor and a RC timer circuit for supplying an electric current to the electromagnetic member at predetermined intervals.

The timer switch of the present invention starts the operation thereof when the setting member is operated. At this time, the setting member is disengaged from the escape wheel. Then, the anchor rocking means operates to rock the anchor. The claws of the rocking anchor are alternately engaged with the escape wheel to intermittently turn the escape wheel. This intermittent turning of the escape wheel is transmitted to the setting member through the clutch means. When a desired period expires, the setting member returns to its original position. As a result, the timer switch stops the operation thereof.

DETAILED DESCRIPTION OF THE INVENTION

FIGS. 1 to 5 illustrate a first embodiment of the timer switch according to the present invention.

Into an opening formed in an upper wall 2 of a switch casing 1, a setting member 3 is slidably inserted. The upper end portion of the setting member 3, which projects outside of the switch casing 1 forms a knob 4 for punching the setting member 3 inside of the switch casing 1.

Figure 3:
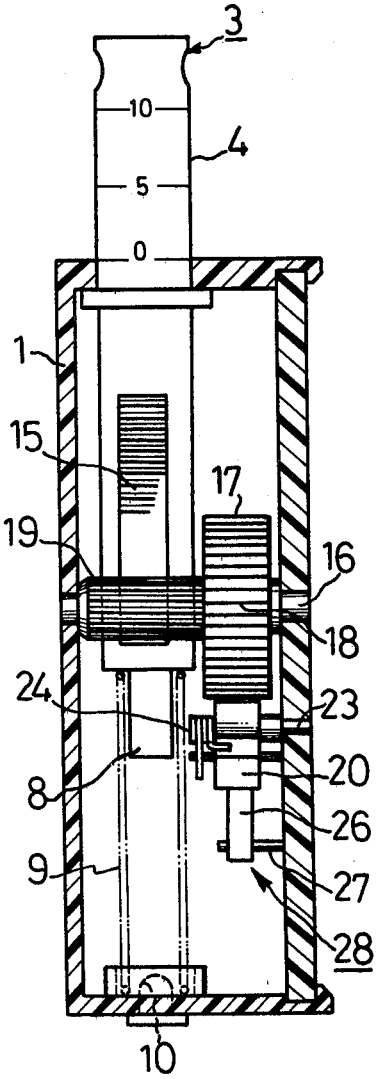
Figure 2:
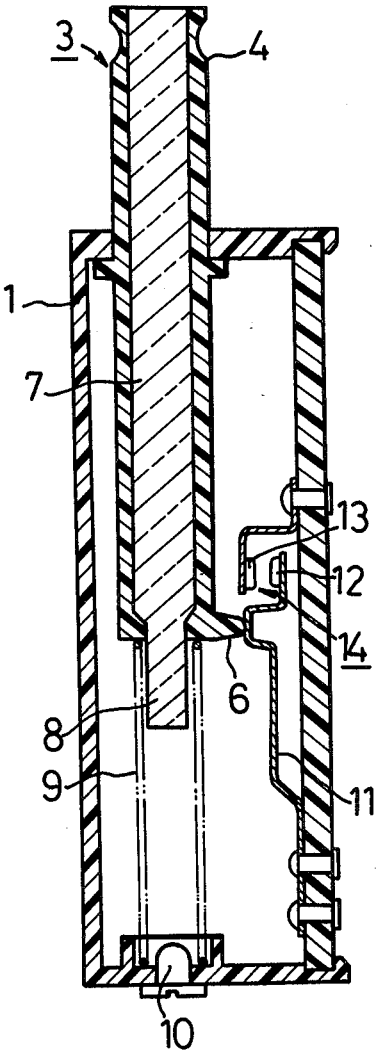
Figure 4:
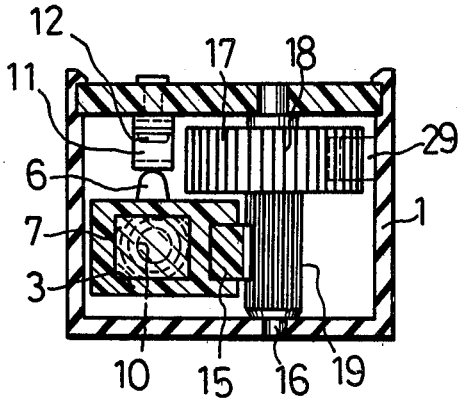
FIG. 4 is a cross sectional view taken along the line IV—IV of FIG. 1.

On the side surface of the knob 4 of the setting member 3, figures showing several predetermined periods, are indicated as illustrated in FIG. 3.

Between the lower end surface of the setting member 3 and the bottom surface of the switch casing 1, a coil spring 9 is disposed for biasing the setting member 3 upward.

The setting member 3 is engaged with the upper wall 2 of the casing 1 in a stopper plate 5 formed therein.

Within the setting member 3, a transparent light conductive resin 7 is inserted.

The lower end of the resin 7 projects from the setting member 3. In the bottom wall of the casing 1, a luminous body 10 such as a luminous diode or a luminous lamp is provided so as to be opened to the projecting end 8 of the resin 7.

Within the switch casing 1, a switching means 14 composed of a movable contact 12 and a fixed contact 13 which is opposed to the movable contact 12, is provided.

The movable contact 12 is disposed on a free end of a movable contact piece 11 made of a leaf spring.

The movable contact piece 11 is electrically connected to the luminous body 10.

In the lower side end of the setting member 3, a projecting portion 6 is formed.

When the setting member 3 is positioned at its upper limit, the projecting portion 6 pushes the movable contact piece 11 to turn off the switching means 14 and when the setting member 3 is pushed downward, the switching means 14 is turned on.

To the side surface of the setting member 3, which is positioned within the casing 1, a rack 15 made of elastic material such as elastomer of polyurethane rubber, is fixed. In the rack 15, teeth are formed so as to be arranged in the moving direction of the setting memer 3.

Within the casing 1, a shaft 16 is disposed so as to cross the side portion of the rack 15. The shaft 16 rotatably supports an escape wheel 17 provided with saw-shaped teeth in its outer peripheral surface, and a pinion 19 which meshes with the rack 15. The escape wheel 17 and the pinion 19 are integrally formed with each other.

Within the casing 1, an anchor 20 provided with claws 21, 22 at upper ends thereof is supported by a shaft 23 so as to be opposed to the escape wheel 17.

The claws 21, 22 are alternately engaged with the teeth of the escape wheel 17 due to the rocking movement of the anchor 20.

A spring 24 is wound round the shaft 23. One end of the spring 24 is engaged with a stopper 110 which is formed in the casing 1 while the other end of the spring 24 is engaged with the anchor 20. Therefore, a turning force is applied to the anchor 20 by means of the spring 24 clockwise in FIG. 1.

From the anchor 20, a rocking contact rod 26 projects downward. Normally, the rocking contact rod 26 contacts with a fixed contact 27 which is formed in the casing 1 and the claw 22 of the anchor 20 meshes with one tooth of the escape wheel 17.

To the side surface of the anchor 20, an iron piece 25 is fixed so as to be opposed to an electromagnetic solenoid 29 which is provided in the inner side surface of the casing 1, at a predetermined distance.

Before the setting member 3 is pushed downward, the escape wheel 17 and the pinion 19 are prevented from turning by the claw 21. Therefore, when the period setting operation by the setting member 3 is started, the rack 15 elastically deforms and is released from the engagement with the pinion 19 which is prevented from turning at this time. As a result, the setting member 3 is allowed to move downward.

When the setting member 3 is pushed downward against the biasing force of the spring 9 to a desired setting period, an electric current is intermittently supplied to the electromagnetic solenoid 29 at predetermined intervals by means of an electric current supplying means which will be explained later.

As a result, the iron piece 25 repeatedly contacts with and separates from the electromagnetic solenoid 29 so that the anchor 20 continues the rocking movement and the claws 21, 22 are alternately engaged with the teeth 18 of the escape wheel 17.

Due to the operation of the anchor 20, the escape wheel 17 intermittently turns clockwise. This turning force is transmitted to the setting member 3 through the pinion 19 and the rack 15. The setting member intermittently moves upward at predetermined timings and by predetermined pitches.

The set period expires when the stopper plate 5 of the setting member 3 contacts with the upper wall 2 of the casing 1.

Hereinafter, the structure of the driving circuit for the electromagnetic solenoid and the operation thereof will be disclosed in detail.

Figure 5:
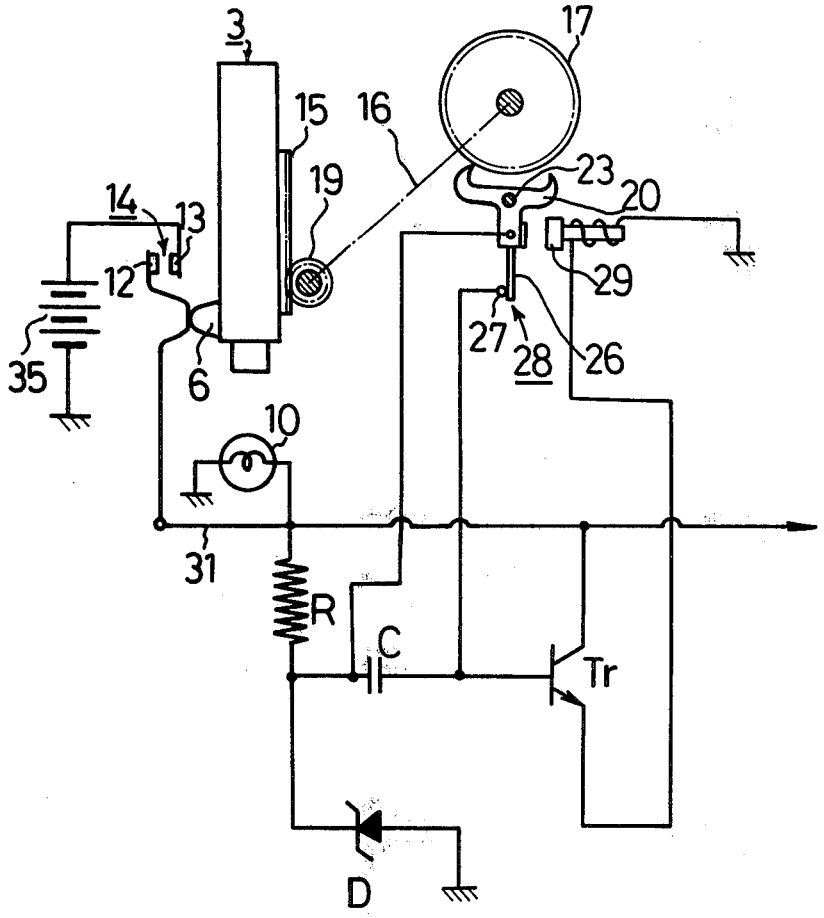
FIG. 5 is a circuit diagram of the first embodiment.

As shown in FIG. 5, the fixed contact 13 of the switching means 14 is connected to a battery 35. The movable contact 12 is connected to one end of a power supply line 31 of which the other end is connected to a wiper driving device (not shown) or the like.

To the power supply line 31, the luminous body 10 a resistor R and a collector of a transistor Tr are connected. To the resistor R, a zener diode D is connected in series and the zener diode is grounded.

Between a junction of the resistor R and the diode D, and the base of the transistor Tr, a condensor C is arranged.

One side of the condensor C is connected to the rocking contact rod 26 of the anchor 20 while the other side thereof is connected to the fixed contact 27.

One end of the electromagnetic solenoid 29 is connected to the emitter of the transistor Tr while the other end thereof is grounded.

When the setting member 3 is pushed downward, the switching means 14 is turned on to light the luminous body 10 connected to the power supply line 31.

Before the setting member 3 is pushed downward, the escape wheel 17 is engaged with the claw 21. Therefore, the escape wheel 17 and the pinion 19 are prevented from turning counterclockwise in FIG. 1. However, by pushing the setting member 3 downward, the rack 15 elastically deforms and disengages from the pinion 19 so as to descend.

When the turning switch 28 composed of the rocking contact rod 26 and the fixed contact 27 is turned on, an electric current is supplied in the transistor Tr through the switch 28. Then, the transistor Tr supplies an emitter current to the electromagnetic solenoid 29.

Then, the anchor 20 is attracted by the energized electromagnetic solenoid 29 to start the rocking movement so that the claw 21 of the anchor 20 contacts with the land of one of the teeth 18 of the escape wheel 17 and slides thereon. As a result, the escape wheel 17 turns clockwise by one tooth thereof by the aid of the coil spring 9. The rack 15 engaged with the pinion 19 which turns together with the escape wheel 17, ascends by predetermined distances. And also, the setting member 3 to which the rack 15 is fixed, ascends.

When the anchor 20 is sttracted by the electromagnetic solenoid 29, the timing switch 28 is turned off. Since a base electric current is continuously supplied to the transistor Tr through the condensor C, the electromagnetic solenoid 29 is continuously energized. However, as the condensor C is charged with electricity, the base electric current gradually decreases and also the emitter electric current of the transistor Tr decreases.

After a predetermined period expires, the electromagnetic solenoid 29 is deenergized. The anchor 20 returns to the original position shown in FIG. 5 by means of the spring 24 to that the timing switch 28 is turned on. At this time, the claw 22 of the rocking member 20 meshes with one of the teeth 18 of the escape wheel 17 to stop the escape wheel 17 from turning.

When the timing switch 28 is turned on, the condensor C discharges so that a base electric current is supplied to the transistor Tr to energize the electromagnetic solenoid 29 again.

The rocking movement of the anchor 20 is repeated to turn the escape wheel 17 clockwise (in FIG. 1) at regular intervals which are determined by the capacity of the condensor C. As a result, the setting member 3 intermittently ascends by predetermined distances.

The setting member 3 continues ascending until the set period, which is determined by the pushing volume, expires. At this time, the switching means is turned off and the driving circuit stops its operation. At the same time, the luminous body 10 goes out.

In the above embodiment, the desired period is set by pushing the setting member 3.

The desired period can be also set by pulling the setting member 3 out of the casing 1. In this case, the set period expires when the setting member 3 is pulled into the casing 1 due to the intermittent operation of the escape wheel 17.

Figure 1:
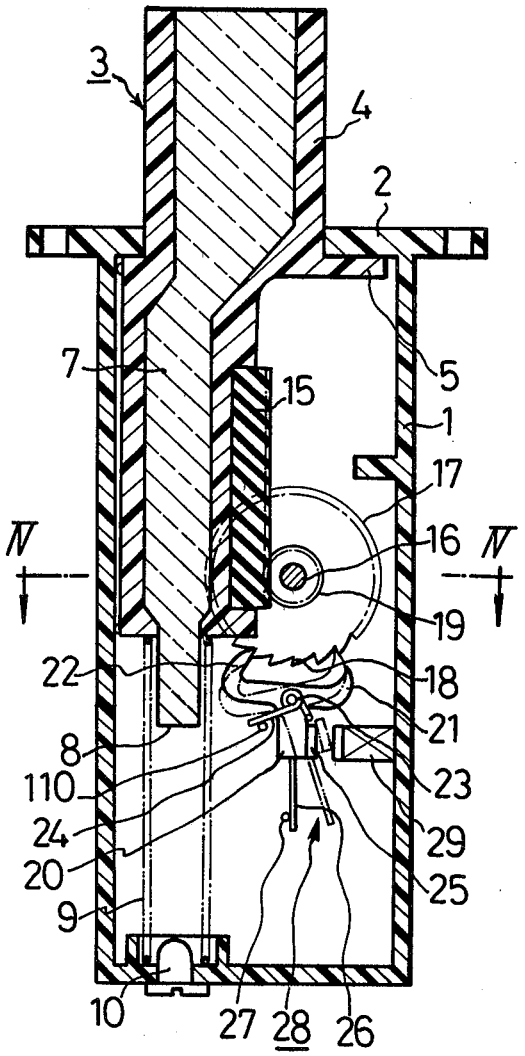
FIGS. 1 to 3 are longitudinal sectional views of a first embodiment of the timer switch according to the present invention, which are taken along different lines thereof.

In this modified embodiment, the direction of the biasing force applied by the coil spring 9 to the setting member 3, the extending direction of the teeth 18 of the escape wheel 17, and the engaging relation of the claws 20, 21 of the anchor 20 to the escape wheel 17 are reverse to those of the first embodiment shown in FIG. 1. And the switching means 14 is turned off when the setting member 3 descends into the casing 1 to its lower limit and is turned on when the setting member 3 is pulled upward.

Figure 6:
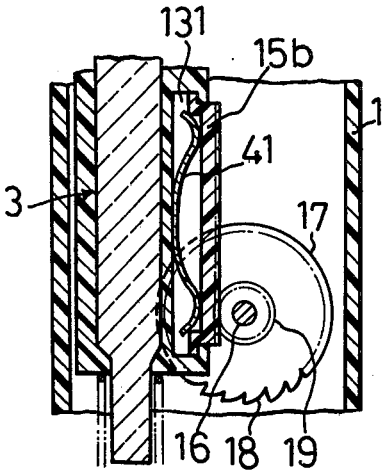
FIG. 6 is a partially cut away longitudinal sectional view of a second embodiment of the timer switch according to the present invention.

FIG. 6 illustrates one portion of a second embodiment of the timer switch according to the present invention. In the side surface of the setting member 3, a groove 131 is formed so as to be opposed to the pinion 19. The rack **15*b* made of nondeformable material is fit into the groove 131 and a leaf spring 41 is disposed within the groove 131 and a leaf spring 41 is disposed within the groove 131 so as to push the rack 15*b* to the pinion 19**.

When the setting member 3 is pushed downward, the rack **15*b* disengages from the pinion 19 to move leftward in FIG. 6, overcoming the spring force of the leaf spring 41. As a result, the setting member 3** starts to descend.

The other construction of the second embodiment is substantially equal to that of the first embodiment.

Figure 7:
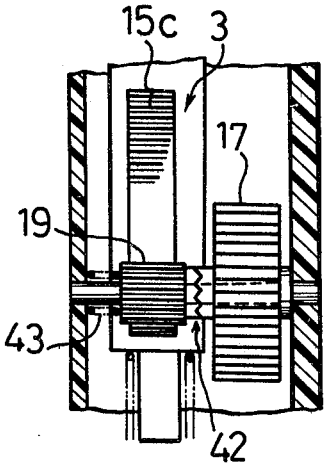
FIG. 7 is a partially cut away longitudinal sectional view of a third embodiment of the timer switch according to the present invention.

FIG. 7 illustrates one portion of a third embodiment of the timer switch according to the present invention.

The contact surfaces of the pinion 19 and the escape wheel 17 are formed into chrysanthemum-shaped gears which fit each other. Thus, a clutch 42 is formed.

A spring 43 is provided so as to push the pinion 19 toward the escape wheel 17.

The rack **15*c* meshing with the pinion 19** is made of nondeformable material.

When the setting member 3 is pushed downward, a turning force is applied to the pinion 19. At this time, the escape wheel 17 is prevented from turning by means of the claw of the rocking member (not shown). However, the pinion 19 slides on the chrysanthemum-shaped surface of the escape wheel 17, overcoming the pushing force of the spring 43 so as to turn in accordance with the downward movement of the rack 15. As a result, the setting member 3 descends.

FIGS. 8 to 14 illustrate a fourth embodiment of the timer switch according to the present invention.

In the upper wall of the casing 1, a circular concave portion 42 is formed and a circulr body 43 is rotatably fixed within the concave portion 42. On the upper wall of the casing 1 graduations 44 showing the set periods, are indicated around the circular concave portion 42. The circular body 43 is provided with a radially extending knob 45. One end of the knob 45 is made sharp to form an indicator 46.

An insulator 41 is fixed to the bottom portion of the casing 1. Within the casing 1, a setting member 47 is rotatably disposed. A lower shaft 48 of the setting member 47 is inserted into the insulator 41 while an upper shaft 49 thereof penetrates the upper wall of the casing 1. The top end of the upper shaft 49 is closely inserted into a groove formed in the circular body 43.

In the upper surface of the setting member 47, teeth 50 are formed so as to surround the upper shaft 49. In the under surface of the setting member 47, an annular groove 51 is formed. Within the annular groove 51, a coil-shaped return spring 52 of which one end is fixed to the insulator 41 and the other end is fixed to the setting member 47, is accomodated. To the setting member 47, a returning force for returning the indicator 46 to the O position of the graduations 44 is applied by means of the spring 52.

Figure 12:
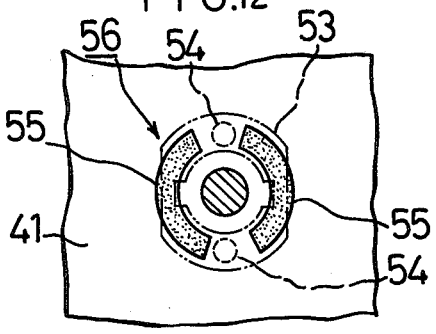
FIG. 12 is a plan view of the switching means of the fourth embodiment.
Figure 13:
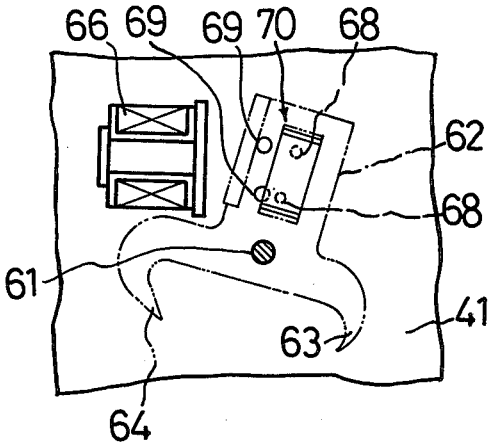
FIG. 13 is a plan view illustrating the anchor, the electromagnetic solenoid and the timing switch of the fourth embodiment.

On the bottom surface of the setting member 47, a ring-shaped movable contact plate 53 is disposed around the lower shaft 48. In the under surface of the plate 53, movable contacts 54 are formed so as to be symmetric with respect to the lower shaft 48. The movable contacts 54 are pushed to the upper surface of the insulator 41 by means of springs 71. On the upper surface of the insulator 41, arc-shaped fixed contacts 55 are disposed so as to be symmetric with respect to the lower shaft 48 as shown in FIG. 12. The movable contacts 54, 54 and the fixed contacts 55, 55 compose a switching means 56.

When the indicator 46 indicates O, the movable contacts 54, 54 are positioned between the fixed contacts 55, 55 so that the switching means is in off state. By turning the knob 45 clockwise in FIG. 8, the movable contacts 54,54 contact with the fixed contacts 55, 55 so that the switching means 56 is turned on.

Figure 10:
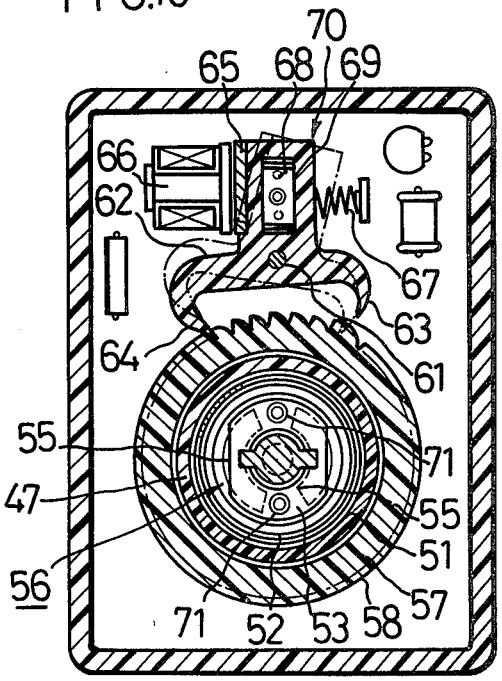
FIG. 10 is a cross sectional view taken along the line X—X of FIG. 9.
Figure 11:
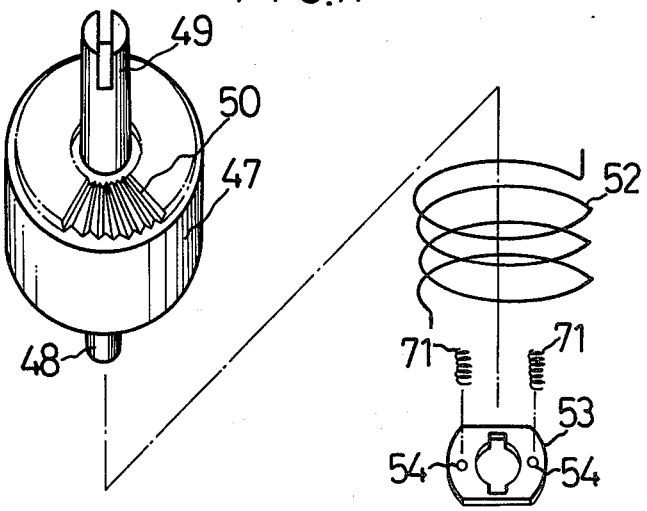
FIG. 11 is an exploded view of the setting member and the switching means of the fourth embodiment.

The setting member 47 is covered with a cup-shape ring gear 57. In the side peripheral surface of the ring gear 57, saw-shaped teeth 58 are formed as shown in FIG. 10. In the under surface of the upper wall of the ring gear 57, the teeth 59 are formed so as to mesh with the teeth 50 formed in the upper surface of the setting member 47. Thus, the ring gear 57 operates as the escape wheel and the rack of the first embodiment. The teeth 59 are pushed to the teeth 50 by a samll biasing force of the coil spring 60 which is interposed between the upper wall of the rear gear 57 and the upper wall of the casing 1.

The teeth 50, 59 compose a clutch. When a large turning force is applied to the knob 45 while the ring gear 57 is fixed, the teeth 50 of the setting member 47 disengage from the teeth 59 of the ring gear 57, overcoming the biasing force of the coil spring 60 so that the setting member 47 turns.

And when the ring gear 57 turns, the setting member 47 which is engaged with the ring gear 57 through the teeth 50, 59, is turned.

On one side of the ring gear 57, a shaft 61 is provided so as to penetrate the insulator 41, and an anchor 62 is rockably supported thereby. The anchor 62 is provided with two claws 63, 64 which are opposed to the teeth 58 of the ring gear 57. These claws 63, 64 are alternately engaged with different teeth 58 of the ring gear 57 due to the rocking movement of the anchor 62.

To one side surface of the anchor 62, a permanent magnet piece 65 is fixed. An electro-magnetic solenoid 66 is mounted on the insulator 41 so as to be opposed to the permanent magnet piece 65 at a predetermined distance. The permanent magnet piece 65 is pushed against the electromagnetic solenoid 66 by means of a spring 67 as indicated by a rigid line in FIG. 10. At this time, one claw 64 of the anchor 62 is engaged with one of the teeth 58.

When an electric current is supplied to the electromagnetic solenoid 66, the solenoid 66 and the permanent magnet piece 65 repulses each other so that the anchor 62 rocks against the pushing force of the spring 67 and changes its position as indicated by a broken line in FIG. 10.

On the under surface of the anchor 62, movable contacts 68, 68 which are pushed toward the insulator 41 by the spring pressure, are formed.

In the insulator 41, fixed contacts 69,69 are formed. They contact with or separate from the movable contacts 68, 68 due to the rocking movement of the anchor 62.

These contacts 68,68 and 69, 69 compose a timing switch 70 which opens and closes a circuit of the aforementioned condensor C.

Hereinafter, the operation of an electromagnetic solenoid driving circuit and device will be explained in detail.

Figure 14:
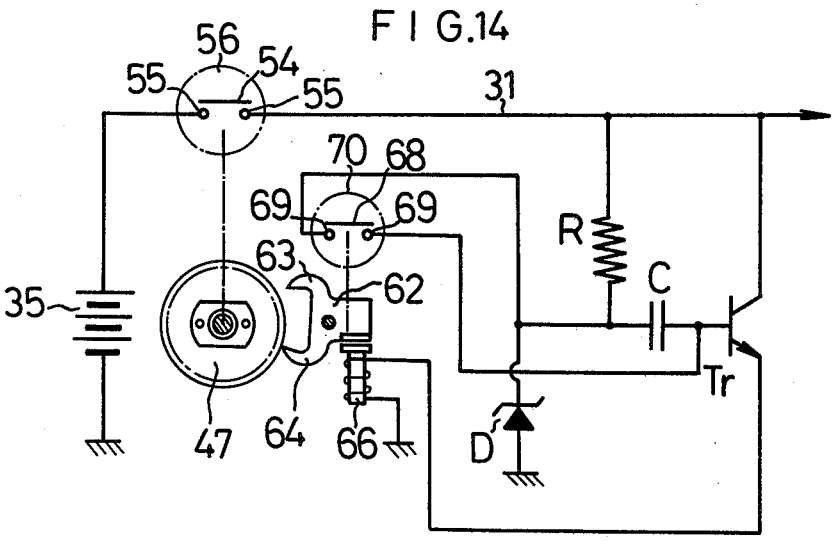
FIG. 14 is a circuit diagram of the fourth embodiment.

As shown in FIG. 14, one of the fixed contacts 55 of the switching means 56 is connected to a battery 35. To the other fixed contact 55, a power supply line 31 leading to a wiper driving device or the like is connected. A resistor R and a collector of the transistor Tr are connected to the power supply line 31, respectively.

The resistor R is connected to a zener diode D in series and the zener diode D is grounded.

Between the junction of the resistor R and the diode D, and the base of the transistor Tr, a condensor C is provided.

One of the fixed contacts 69 of the timing switch 70 is connected to one side of the condensor C while the other fixed contact 69 is connected to the other side of the condensor C.

One end of the electromagnetic solenoid 66 is connected to the emitter of the transistor Tr while the other end thereof is grounded.

Figure 8:
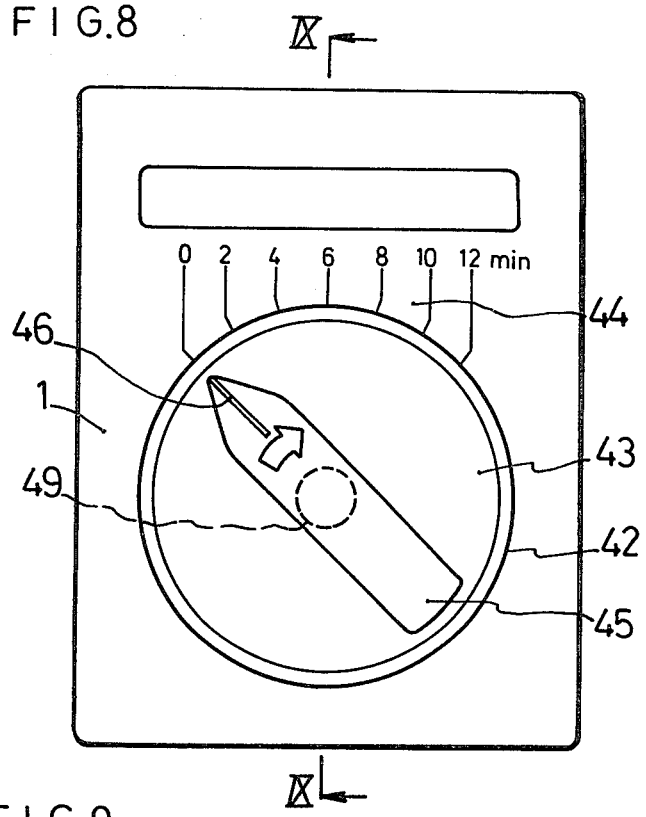
FIG. 8 is a plan view of a fourth embodiment of the timer switch according to the present invention.
Figure 9:
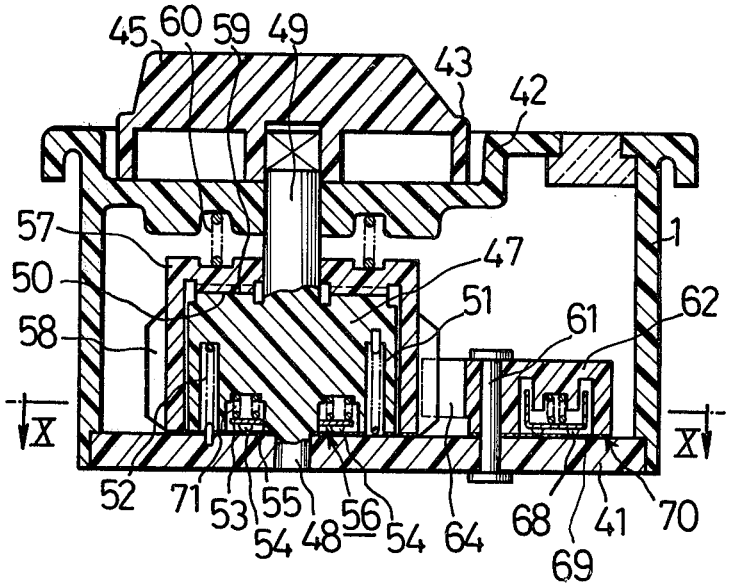
FIG. 9 is a longitudinal sectional view of the fourth embodiment.

When the knob 45 is turned clockwise in FIG. 8, the switching means 56 is switched on.

When a turning force is applied to the knob 45, the ring gear 57 engages with the claw 64 of the anchor 62 so that the ring gear 57 does not turn about the shaft 49. At this time, the teeth 50 of the setting member 47 disengage from the teeth 59 of the ring gear 57 so that the setting member 47 becomes free from the ring gear 57.

When the timing switch 70 composed of the movable contacts 68,68 and the fixed contacts 69,69 is on, an electric current is supplied to the transistor Tr through the switch 70. Then, the transistor Tr generates an emitter current. The electromagnetic solenoid 66 is energized by this emitter current. As a result, the anchor 62 repulses the electromagnetic solenoid 66 to start rocking. The claw 63 contacts with the land of one of the saw-shaped teeth 58 and slides thereon.

Consequently, the ring gear 57 turns counterclockwise by one tooth thereof and the setting member 47 which is engaged with the ring gear 57 through teeth 50,59 also turns counterclockwise.

When the anchor 62 repulses the electromagnetic solenoid 66 and starts rocking, the switch 70 is turned off. However, to the transistor Tr, a base current is continuously supplied through the condensor C so that the electromagnetic solenoid 66 is kept energized.

The base current gradually decreases as the condensor C is charged with electricity. The emitter current of the transistor Tr also decreases.

After a predetermined period expires, the electromagnetic solenoid 66 is disenergized. Then, the anchor 62 returns again to the position shown in FIG. 10 by means of the spring 67 and the timing switch 70 is turned on. At this time, the claw 64 of the anchor 62 is engaged with one of the teeth 58 of the ring gear 57 to stop the ring gear 57 and the setting member 47 from turning.

When, the timing switch 70 is on, the condensor C discharges electricity so that a base current is supplied to the transistor Tr to energize the electromagnetic solenoid 66 again.

In the above described manner, the anchor 62 repeatedly rocks. The ring gear 57 turns counterclockwise in FIG. 8 at predetermined intervals which depend on the capacity of the condensor C of the ring gear 57.

The setting member 47 intermittently turns by predetermined angles. After a predetermined period which is determined by the set angle of the knob 45, expires, the indicator 46 of the setting member 47 returns to the position O. As a result, the switching means 56 is turned off and the circuit stops its operation.

As described above, in the timer switch of the present invention, the RC timer circuit composed of a condensor and a resistor, operates to rock an anchor for engaging with or disengaging from the escape wheel. Since the duration of every rocking movement is very short, the RC timer circuit can precisely set the rocking duration of the anchor.

Due to every rocking movement of the anchor, the escape wheel turns by one tooth thereof, and the setting member returns by predetermined distances at regular intervals. When a predetermined period which is set by the setting member, expires, the setting member returns its original position.

Furthermore, since the gear formed in the setting member can be engaged with or disengage from the gear which rotates together with the escape wheel, the setting member can easily disengage from the gear rotating together with the escape wheel when the setting member is pushed or rotated.

Furthermore, according to the present invention, a plurality of periods can be set and the timer switch of the present invention operates without error in each set period.

Having now fully described the invention, it will be apparent to one of ordinary skill in the art that many changes and modifications can be made thereto without departing from the spirit or scope of the invention as set forth herein.

What is claimed is:

1. A timer switch to be installed in a vehicle, comprising:

a casing;

a setting member for setting a desired period, which is housed in said casing and is moved along its axis when a desired period is set;

a switching means which is turned on when a desired period is set by said setting member;

a biasing means for biasing said setting member to its original position;

an escape wheel provided with saw-shaped teeth in the outer periphery thereof, which is rotatably supported within said casing;

a clutch means which is interposed between said setting member and said escape wheel for disengaging said setting member from said escape wheel while said setting member is operated and engaging said setting member with said escape wheel when said escape wheel turns to return said setting member to its original position;

an anchor provided with a pair of claws, which is rockably supported within said casing so as to be opposed to said escape wheel; and an anchor rocking means for rocking said anchor at constant periods to engage said pair of claws with said teeth of said escape wheel alternately;

said anchor rocking means being provided with a magnetic body fixed to said anchor, an electromagnetic member disposed within said casing so as to be opposed to said magnetic body, and an electric current supplying means for supplying an electric current to said electromagnetic member intermittently.

2. A timer switch according to claim 1, wherein;

said electric current supplying means comprises:

a transistor of which emitter is connected to said electromagnetic member;

a condensor of which one side is connected to the base of said transistor and the other side is connected to said switching means; and another switching means which is connected to said condensor in parallel; said another switching means being turned on or off due to the rocking movement of said anchor.

3. A timer switch according to claim 1, wherein:

said setting member is formed like a rod; and one end of said setting member forms a knob on which several periods are indicated;

whereby a desired period can be set by pushing said knob into said casing or pulling said knob out of said casing.

4. A timer switch according to claim 3, wherein:

said clutch means comprises:

a rack made of elastic resin or rubber, which is provided on the side surface of said setting member; and a pinion which is integrally formed with said escape wheel so as to be coaxial therewith and is engaged with said rack.

5. A timer switch according to claim 3, wherein:

said clutch means comprises:

a rack which is provided on the side surface of said setting member through an elastic member; and a pinion which is integrally formed with said escape wheel so as to be coaxial therewith and is engaged with said rack.

6. A timer switch according to claim 3, wherein:

said clutch means comprises:

a rack which is provided on the side surface of said setting member;

a pinion which is engaged with said rack;

a first teeth formed in one end of a shaft rotatably supporting said pinion;

a second teeth formed in one end of a shaft rotatably supporting said escape wheel, which are meshed with said first teeth; and a biasing means for biasing said pinion shaft to said escape wheel shaft so that said first teeth is pushed to said second teeth.

7. A timer switch according to claim 1, wherein:

said setting member is formed like a column;

said setting member is provided with a knob in the upper surface thereof for rotating said setting member; and around said knob, several periods are indicated.

8. A timer switch according to claim 7, wherein:

said escape wheel is rotatably disposed around said setting member so as to be coaxial with said setting member;

said escape wheel is composed of a cylindrical body having a top wall which is opposed to the upper surface of said setting member;

said escape wheel is provided with saw-shaped teeth in the outer peripheral surface thereof, which are engageable with said pair of claws of said anchor; and said clutch means comprising a first teeth which are formed in said upper surface of said setting member, a second teeth which are formed in the under surface of said top wall of said escape wheel so as to be meshed with said first teeth, and a biasing means for biasing said top wall of said escape wheel to said upper surface of said setting member.

9. A timer switch to be installed in a vehicle, comprising:

a casing;

a setting member for setting a desired period, which is housed in said casing and is moved when a desired period is to be set;

a switching means which is turned on when a desired period is set by said setting member;

a biasing means for biasing said setting member to its original position;

an escape wheel provided with saw-shaped teeth in the outer periphery thereof, which is rotatably supported within said casing;

a clutch means which is interposed between said setting member and said escape wheel for disengaging said setting member from said escape wheel while said setting member is operated and engaging said setting member with said escape wheel when said escape wheel turns to return said setting member to its original position;

an anchor provided with a pair of claws, which is rockably supported within said casing so as to be opposed to said escape wheel; and an anchor rocking means for rocking said anchor at constant periods to engage said pair of claws with said teeth of said escape wheel alternately;

said anchor rocking means being provided with a magnetic body fixed to said anchor, an electromagnetic member disposed within said casing so as to be opposed to said magnetic body, and an electric current supplying means for supplying an electric current to said electromagnetic member intermittently, said electric current supplying means comprising:

a transistor of which emitter is connected to said electromagnetic member;

a condensor of which one side is connected to the base of said transistor and the other side is connected to said switching means; and another switching means which is connected to said condensor in parallel; said another switching means being turned on or off due to the rocking movement of said anchor.

10. A timer switch to be installed in a vehicle, comprising:

a casing;

a setting member for setting a desired period, which is housed in said casing and is moved when a desired period is to be set;

a switching means which is turned on when a desired period is set by said setting member;

a biasing means for biasing said setting member to its original position;

an escape wheel provided with saw-shaped teeth in the outer periphery thereof, which is rotatably supported within said casing;

a clutch means which is interposed between said setting member and said escape wheel for disengaging said setting member from said escape wheel while said setting member is operated and engaging said setting member with said escape wheel when said escape wheel turns to return said setting member to its original position;

an anchor provided with a pair of claws, which is rockably supported within said casing so as to be opposed to said escape wheel; and an anchor rocking means for rocking said anchor at constant periods to engage said pair of claws with said teeth of said escape wheel alternately;

said anchor rocking means being provided with a magnetic body fixed to said anchor, an electromagnetic member disposed within said casing so as to be opposed to said magnetic body, and an electric current supplying means for supplying an electric current to said electromagnetic member intermittently, said setting member is formed like a rod; and one end of said setting member forms a knob on which several periods are indicated;

whereby a desired period can be set by pushing said knob into said casing or pulling said knob out of said casing.

11. A timer switch according to claim 10, wherein:

said clutch means comprises:

a rack made of elastic resin or rubber, which is provided on the side surface of said setting member; and a pinion which is integrally formed with said escape wheel so as to be coaxial therewith and is engaged with said rack.

12. A timer switch according to claim 10, wherein:

said clutch means comprises:

a rack which is provided on the side surface of said setting member through an elastic member; and a pinion which is integrally formed with said escape wheel so as to be coaxial therewith and is engaged with said rack.

13. A timer switch according to claim 10, wherein:

said clutch means comprises:

a rack which is provided on the side surface of said setting member;

a pinion which is engaged with said rack;

a first teeth formed in one end of a shaft rotatably supporting said pinion;

a second teeth formed in one end of a shaft rotatably supporting said escape wheel, which are meshed with said first teeth; and a biasing means for biasing said pinion shaft to said escape wheel shaft so that said first teeth is pushed to said second teeth.

14. A timer switch to be installed in a vehicle, comprising:

a casing;

a setting member for setting a desired period, which is housed in said casing and is moved when a desired period is set;

a switching means which is turned on when a desired period is set by said setting member;

a baising means for biasing said setting member to its original position;

an escape wheel provided with saw-shaped teeth in the outer periphery thereof, which is rotatably supported within said casing;

a clutch means which is interposed between said setting member and said escape wheel for disengaging said setting member from said escape wheel while said setting member is operated and engaging said setting member with said escape wheel when said escape wheel turns to return said setting member to its original position;

an anchor provided with a pair of claws, which is rockably supported within said casing so as to be opposed to said escape wheel; and an anchor rocking means for rocking said anchor at constant periods to engage said pair of claws with said teeth of said escape wheel alternatively;

said anchor rocking means being provided with a magnetic body fixed to said anchor, an electromagnetic member disposed within said casing so as to be opposed to said magnetic body, and an electric current supplying means for supplying an electric current to said electromagnetic member intermittently, said escape wheel is rotatably disposed around said setting member so as to be coaxial with said setting member;

said escape wheel is composed of a cylindrical body having a top wall which is opposed to the upper surface of said setting member;

said escape wheel is provided with saw-shaped teeth in the outer peripheral surface therof, which are engageable with said pair of claws of said anchor; and said clutch means comprising, a first teeth which are formed in said upper surface of said setting member, a second teeth which are formed in the under surface of said top wall of said escape wheel so as to be meshed with said first teeth, and a biasing means for biasing said top wall of said escape wheel to said upper surface of said setting member.

* * * * *